US010856684B2

(12) United States Patent
Mauri et al.

(10) Patent No.: US 10,856,684 B2
(45) Date of Patent: Dec. 8, 2020

(54) COLLAPSIBLE HANGER

(71) Applicants: Susana Mauri, Miami, FL (US); Enrique Peña Rodriguez, Miami, FL (US)

(72) Inventors: Susana Mauri, Miami, FL (US); Enrique Peña Rodriguez, Miami, FL (US)

( * ) Notice: Subject to any disclaimer, the term of this patent is extended or adjusted under 35 U.S.C. 154(b) by 64 days.

(21) Appl. No.: 16/280,514

(22) Filed: Feb. 20, 2019

(65) Prior Publication Data

US 2019/0365131 A1 Dec. 5, 2019

Related U.S. Application Data

(63) Continuation-in-part of application No. 29/674,015, filed on Dec. 19, 2018, now Pat. No. Des. 870,469.

(60) Provisional application No. 62/680,693, filed on Jun. 5, 2018.

(51) Int. Cl.
*A47G 25/40* (2006.01)

(52) U.S. Cl.
CPC ..... *A47G 25/4023* (2013.01); *A47G 25/4053* (2013.01)

(58) Field of Classification Search
CPC .. A47G 25/4023; A47G 25/4015–4076; A47G 25/4084; A47G 25/4092; A47G 25/40; A47G 25/14; A47G 25/20; A47G 25/24; A47G 25/28
See application file for complete search history.

(56) References Cited

U.S. PATENT DOCUMENTS

| | | | | | |
|---|---|---|---|---|---|
| 958,366 | A * | 5/1910 | Clausen | A47G 25/28 | 223/85 |
| 959,687 | A * | 5/1910 | Altermatt | A47G 25/4038 | 223/85 |
| 1,111,147 | A * | 9/1914 | Fogde | A47G 25/4023 | 223/89 |
| 2,754,038 | A * | 7/1956 | Varker | A47G 25/4023 | 223/94 |
| 4,117,960 | A | 10/1978 | Bengsch et al. | | |
| 4,673,116 | A | 6/1987 | Keller | | |
| 4,948,019 | A | 8/1990 | Rodum | | |
| 5,383,584 | A | 1/1995 | Adams | | |
| 5,687,888 | A * | 11/1997 | Chang | A47G 25/4038 | 223/85 |

(Continued)

FOREIGN PATENT DOCUMENTS

GB 2422536 * 8/2006

*Primary Examiner* — Ismael Izaguirre
(74) *Attorney, Agent, or Firm* — Boudwin Intellectual Property; Daniel Boudwin

(57) ABSTRACT

A collapsible hanger for preserving clothing articles. The collapsible hanger includes a rigid center bar having a connector below a hooked top portion of the rigid center bar. A bottom portion of the rigid center bar is attached to a first end of a pair of flexible arms. Each flexible arm of the pair of flexible arms attach to an aperture at a second end. The aperture is configured to receive the rigid center bar therethrough. The rigid center bar may be vertically adjusted such that it slides through the aperture to transition the collapsible hanger between a collapsed and an expanded configuration. The collapsible hanger may be collapsed when inserted into an article of clothing, expanded once inside the article of clothing, and secured in the expanded position.

9 Claims, 6 Drawing Sheets

(56) References Cited

U.S. PATENT DOCUMENTS

| | | | | |
|---|---|---|---|---|
| 6,230,945 | B1 * | 5/2001 | Licari | A47G 25/28 223/85 |
| 7,237,702 | B2 | 7/2007 | Landis et al. | |
| 7,743,954 | B2 * | 6/2010 | Chiu | A47G 25/4023 223/89 |

* cited by examiner

COLLAPSIBLE HANGER

CROSS REFERENCE TO RELATED APPLICATIONS

This application claims the benefit of U.S. Provisional Application No. 62/680,693 filed on Jun. 5, 2018. This application also claims the benefit of U.S. Design application No. 29/674,015 filed on Dec. 19, 2018. The above identified patent application is herein incorporated by reference in its entirety to provide continuity of disclosure.

BACKGROUND OF THE INVENTION

The present invention relates to an improved hanger. More particularly, the present invention provides a collapsible hanger for preserving the shape or integrity of one or more clothing items.

As clothing prices rise many individuals do not want to buy as many new clothes as they once would have. Keeping clothes nicer for longer is now a priority many individuals are faced with. This priority often leads to individuals hanging much or all of their clothes on clothing hangers. However, many clothing hangers often stretch or pull on the collar or arm sleeve of a garment, such as a jacket, shirt, dress, or the like, when placing the garment on the clothing hanger. With repeated and prolonged use, the garment may lose its shape or elasticity, and become permanently deformed. Accordingly, a solution to enable an individual to both organize and preserve their clothing, without stretching or damaging the clothing, is desired.

Consequently, there is a need for an improvement to the process of hanging clothes. The present invention substantially diverges in design elements from the known art, while at the same time solves a problem many individuals have. In this regard, the present invention substantially fulfills these needs.

SUMMARY OF THE INVENTION

The present invention provides a collapsible hanger wherein the same can be utilized for providing convenience for the user when hanging clothes. The present system comprises a collapsible hanger with a hooked top portion attached to a rigid center bar. The rigid center bar having a connector disposed below the hooked top portion. A bottom portion of the center bar having flexible arms attached to the center bar. The flexible arms having a flexible portion between the first end and a second end. The second end of each arm is attached to an aperture. The aperture is configured to have the rigid center bar therethrough. The aperture is configured to lock to the connector fixing the hanger is an expanded position.

Other objects, features and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 2:
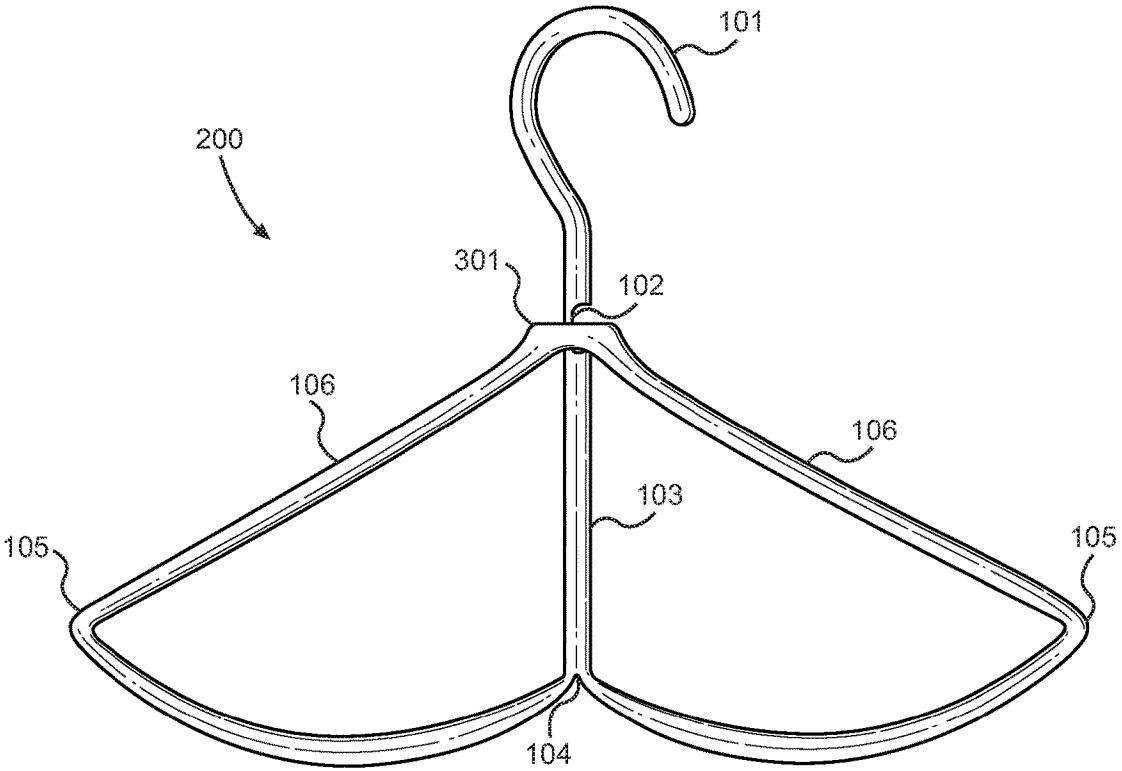
FIG. 2 shows a front view of an embodiment of the hanger in a locked position.

Reference is made herein to the attached drawings. Like reference numerals are used throughout the drawings to depict like or similar elements of the collapsible hanger. For the purposes of presenting a brief and clear description of the present invention, a preferred embodiment will be discussed as used for the collapsible hanger. The figures are intended for representative purposes only and should not be considered to be limiting in any respect.

Figure 1:
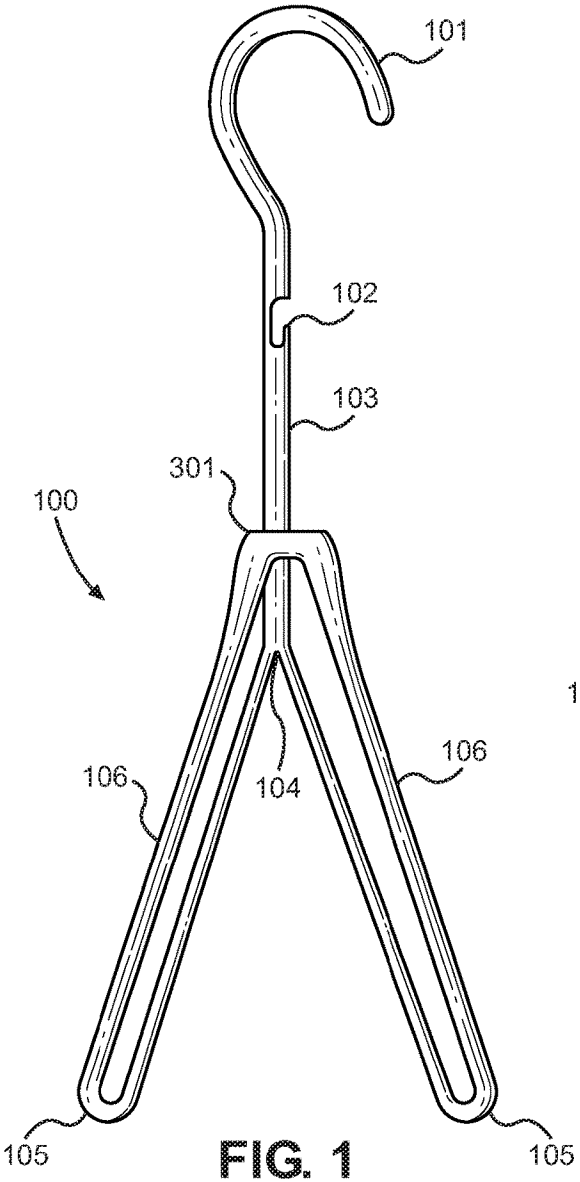
FIG. 1 shows a front view of an embodiment of the hanger in a folded position.

Referring now to FIG. 1 and FIG. 2, there is shown an embodiment of the hanger is a folded position 100 and a locked out position 200. The top portion 101 is in a hook configuration. A connector 102 can be seen below the hooked top portion 101 on the rigid center bar 103. The flexible arms 106 may be attached to the center bar 103 by a flexible portion 104 to allow the arms to extend and fold. A second flexible portion 105 is disposed between a first end and a second end of the flexible arms 106 to allow the arms to fold back toward the center bar 103. The arms 106 can be seen attached to an aperture 301. In one embodiment the hanger is one continuous piece. This allows the hanger to be easily made in a mold. However, it is also a part of this disclosure where the hanger can be comprised of several independent parts then connected together forming the hanger.

Figure 3:
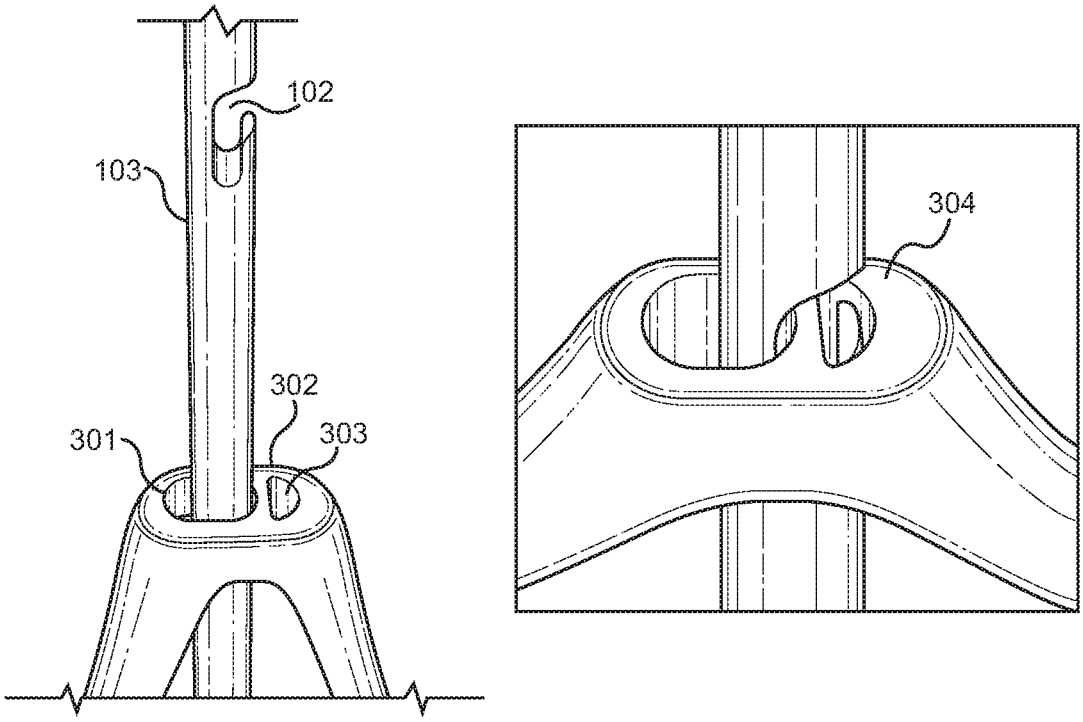
FIG. 3 shows a front zoomed view of an embodiment of the hanger using a notch to hold the hanger in a locked position.

Referring now to FIG. 3, the aperture 301 can be seen disposed around the rigid center bar 103. Further, in the embodiment of FIG. 3 there is a cross bar 302 that runs across the aperture 301 and allows a hole 303 to be created. The cross bar 302 is configured to hook to a connector as seen in zoomed view 304. This bar is not required for the hanger to function. An embodiment is envisioned where the aperture can lock into the notch with no cross bar.

Figure 4:
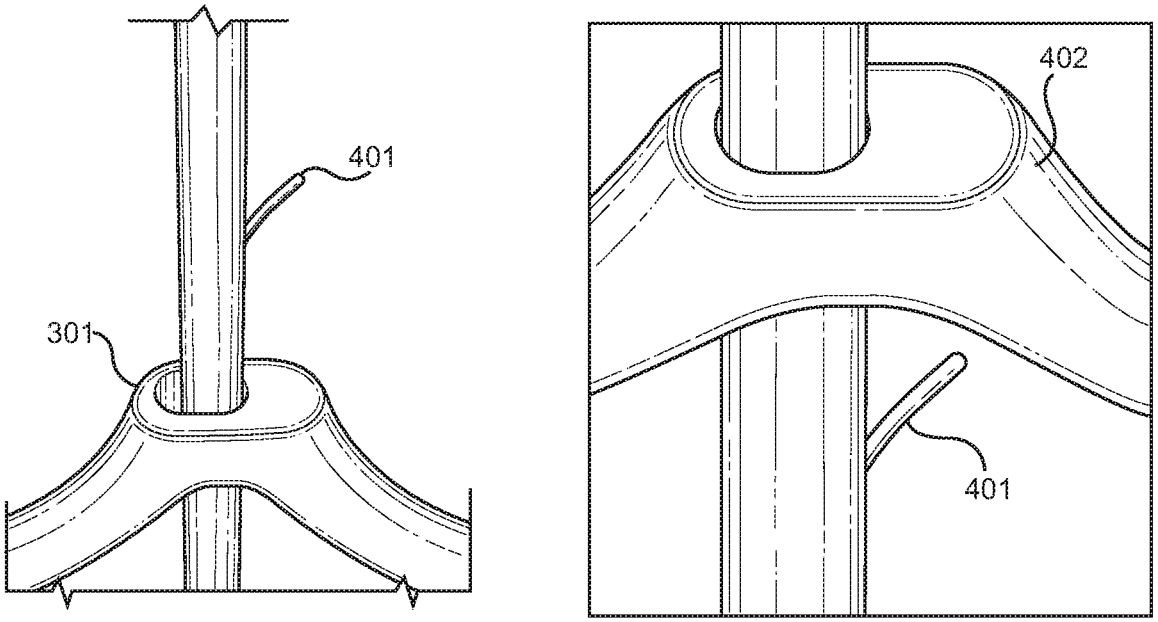
FIG. 4 shows a front zoomed view of an embodiment of the hanger using a push button to hold the hanger in a locked position.

Referring now to FIG. 4, the aperture is pictured without the cross bar. In this embodiment connector is a push button 401. When the hanger is in the locked position the push button 401 will lock under the aperture shown by 402. The push button is of sufficient strength the hold the hanger in the locked out position. The hanger can then be collapsed once the push button 401 is pressed against the ridged center bar. This will allow the aperture to slide over the push button 401 and collapse the hanger.

Figure 5:
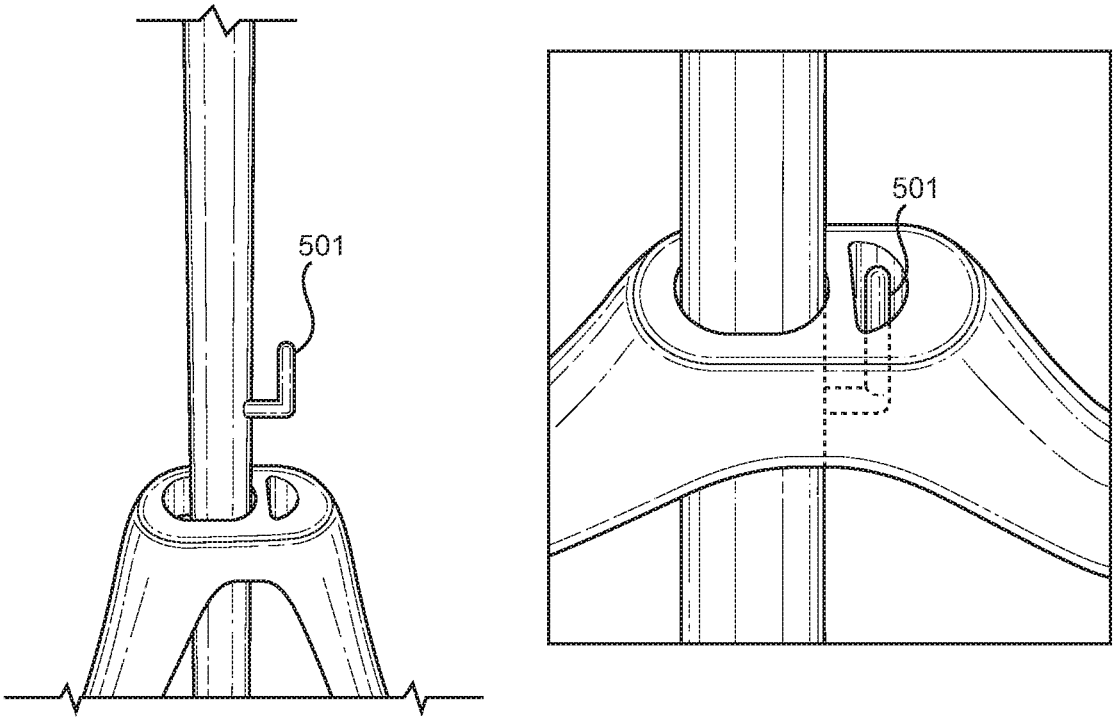
FIG. 5 shows a front zoomed view of an embodiment of the hanger using a hook to hold the hanger in a locked position.

Referring now to FIG. 5, there is shown an embodiment of the hanger where there is a hook used to hold the hanger in the locked out position. The hook 501 is positioned in a similar sport to where the notch would be located. In this embodiment the hook is a protrusion from the center bar. This will allow the center bar to be strengthened because there will not be a notch in the bar. In this embodiment the aperture will be large enough to allow sufficient room for the hook 501 to pass therethrough. Once the aperture is above the hook 501 the flexible arms will be positioned such that the hook locks under one of the arms holding the hanger in a locked out position.

Figure 6:
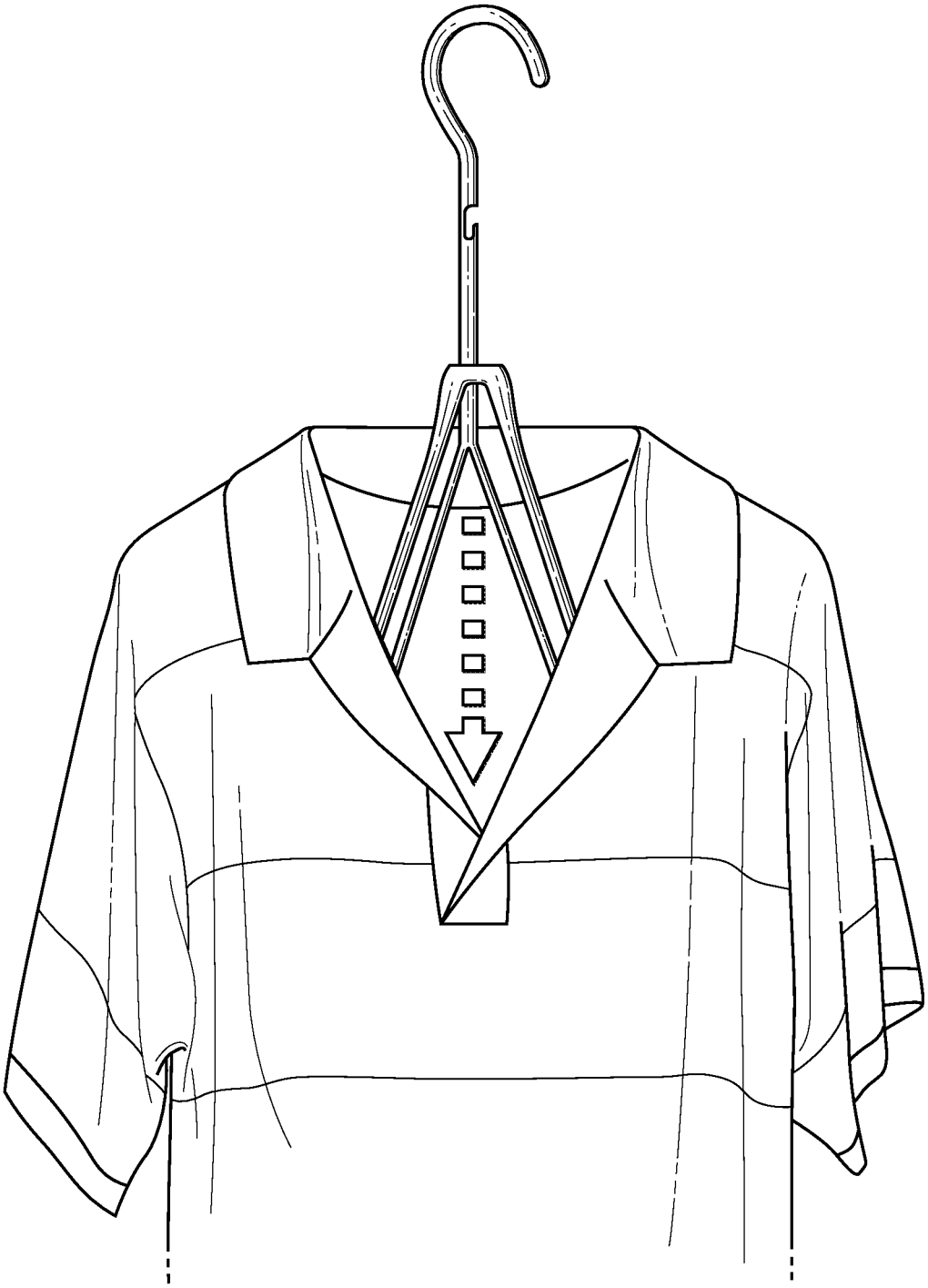
FIG. 6 shows a prospective embodiment of the hanger in a folded position to enter a shirt for hanging.
Figure 7:
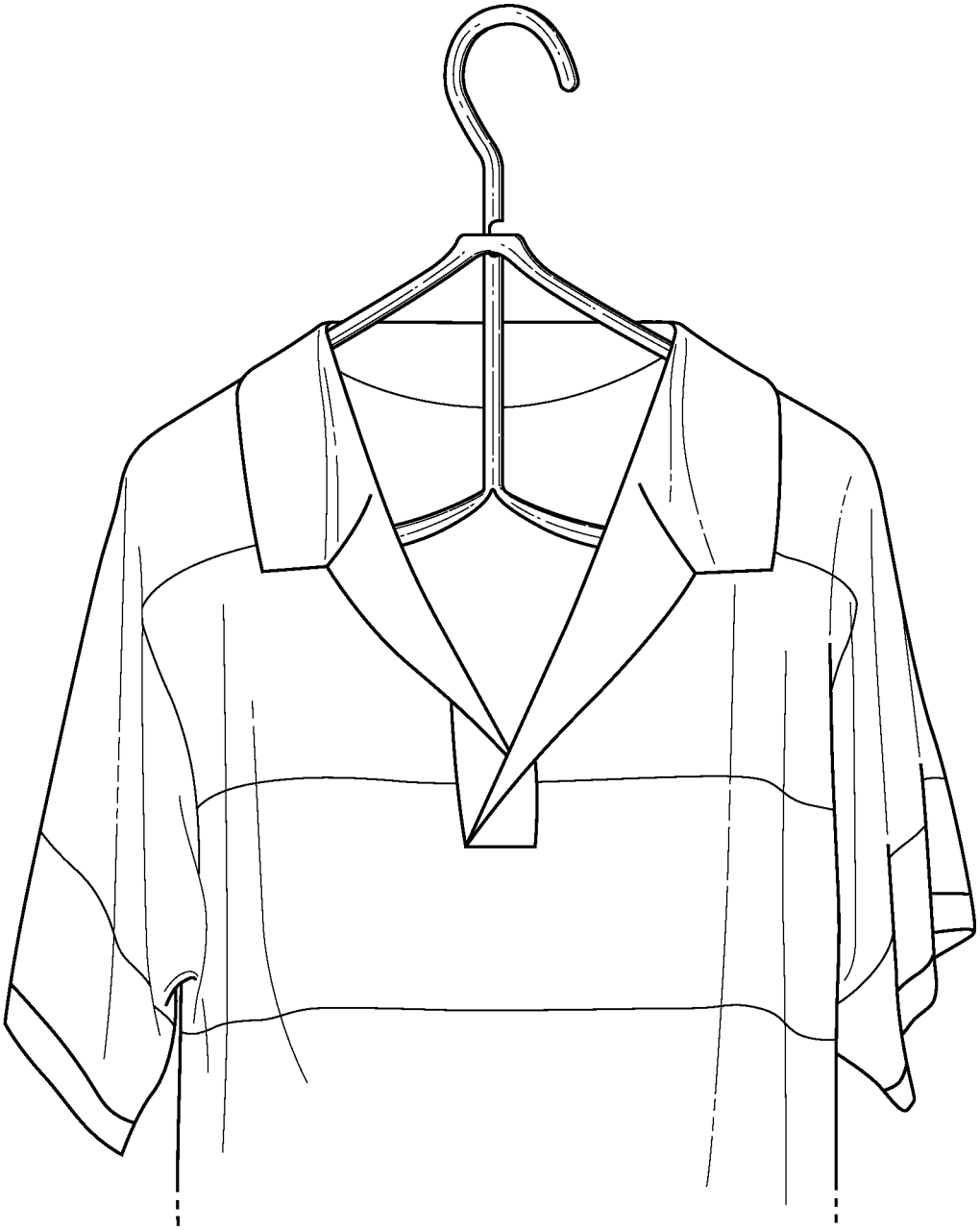
FIG. 7 shows a prospective view of an embodiment where the hanger is in a locked position holding clothes up.

Referring to FIG. 6, the hanger is in a folded position to allow the hanger to enter a shirt without stretching the collar. The hanger when in a folded position is not as wide as the collar. This allows for the hanger to be placed through the top of a garment without stretching the garment. Once the hanger is placed in the proper place of the garment it can be placed in the locked out position. FIG. 7, shows an embodiment of the hanger in a locked position fully supporting the shirt to be hung. While a shirt is used in the FIGs it should be understood that a shirt is merely an example and that any item that requires a hanger can be hung using this Collapsible Hanger.

Figure 8:
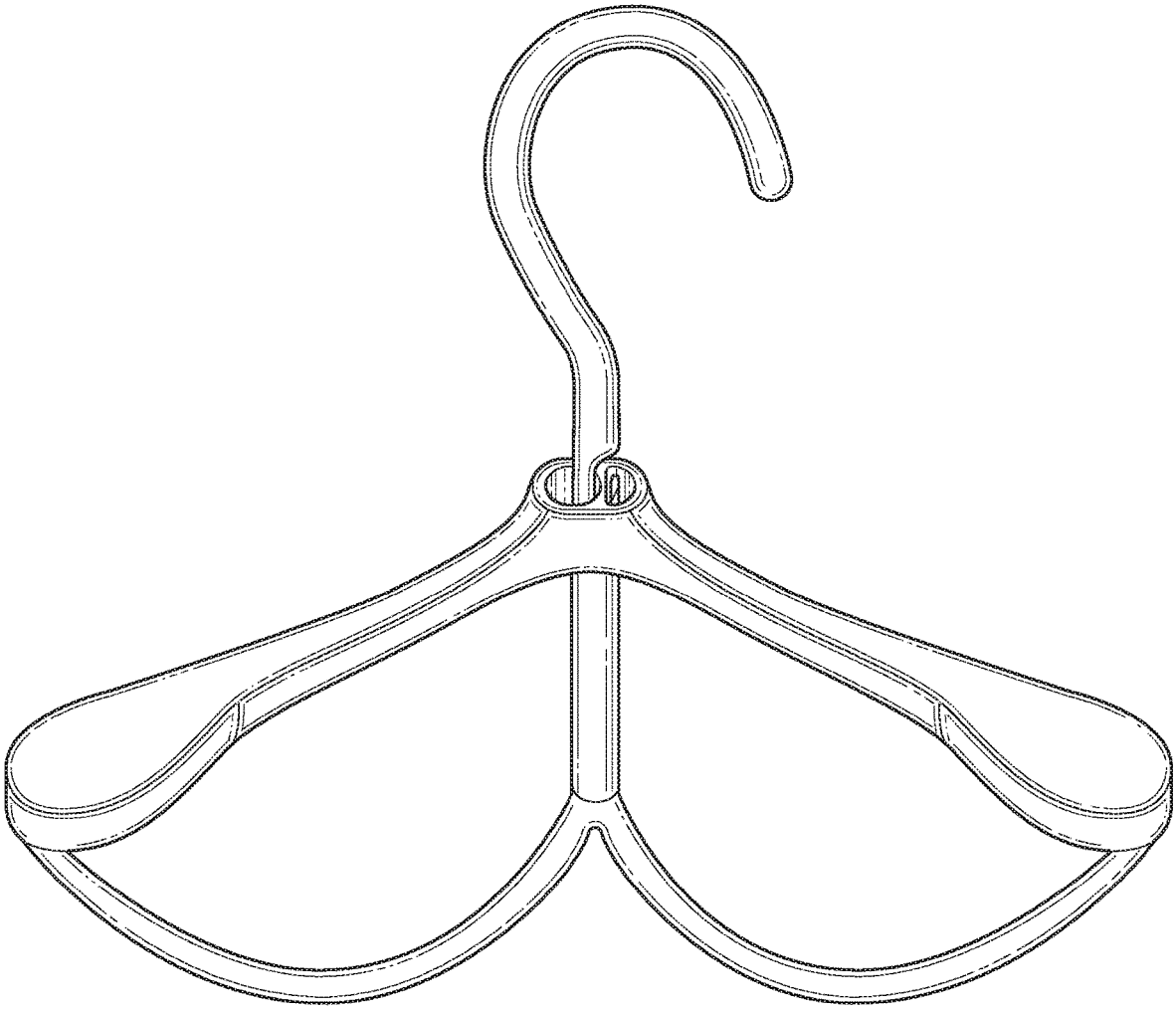
FIG. 8 shows a top down view of a hanger that widens toward a flexible portion.

Referring to FIG. 8, the arms can be seen to be wider toward the second flexible portion in order to better support a coat or the like. Further, the flexible arms are beveled to allow for an article of clothing to better sit on the hanger. The arms may further widen as the arms goes from the aperture towards the second flexible portion. This will allow for the hanger to be fit to different clothing such as suit coats better.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A collapsible hanger, comprising:

a hooked top portion attached to a rigid center bar;

the rigid center bar includes a connector disposed thereon, wherein a bottom portion of the rigid center bar is attached to a pair of flexible arms at a first end via a flexible portion;

wherein each flexible arm of the pair of flexible arms includes a second flexible portion disposed between the first end and a second end;

the second end of each flexible arm is attached together, wherein the attachment forms an aperture;

the aperture is configured to have the center bar slideably disposed therethrough;

a hook connector is secured perpendicular to the rigid center bar, wherein the hook connector will hold the collapsible hanger in an expanded position when located on a bottom side of the attachment of the flexible arms.

2. The collapsible hanger of claim 1, wherein the aperture has a bar attached therethrough such that the bar will rest on the hook connector holding the collapsible hanger in an extended position.

3. The collapsible hanger of claim 1, wherein the collapsible hanger is made from a continuous single piece.

4. The collapsible hanger of claim 1, wherein the hanger has a beveled portion between the flexible portion and the aperture, wherein the beveled portion is the rounded section of the arm.

5. The collapsible hanger of claim 1, wherein the hanger widens as it approaches the flexible portion.

6. A collapsible hanger, consisting of:

a hooked top portion attached to a rigid center bar;

the rigid center bar includes a connector disposed thereon, wherein a bottom portion of the rigid center bar is attached to a pair of flexible arms at a first end via a flexible portion;

wherein each flexible arm of the pair of flexible arms includes a second flexible portion disposed between the first end and a second end;

the second end of each flexible arm is attached together, wherein the attachment forms an aperture;

the aperture is configured to have the center bar slideably disposed therethrough;

a hook connector is secured perpendicular to the rigid center bar, wherein the hook connector will hold the collapsible hanger in an expanded position when located on a bottom side of the attachment of the flexible arms.

7. The collapsible hanger of claim 6, wherein the collapsible hanger is made from a continuous single piece.

8. The collapsible hanger of claim 6, wherein the hanger has a beveled portion between the flexible portion and the aperture, wherein the beveled portion is the rounded section of the arm.

9. The collapsible hanger of claim 6, wherein the hanger widens as it approaches the flexible portion.

* * * * *